United States Patent [19]

Scott et al.

[11] 4,342,036

[45] Jul. 27, 1982

[54] MULTIPLE FREQUENCY BAND, MULTIPLE BEAM MICROWAVE ANTENNA SYSTEM

[75] Inventors: William G. Scott, Saratoga; Howard H. Luh, Sunnyvale, both of Calif.

[73] Assignee: Ford Aerospace & Communications Corporation, Detroit, Mich.

[21] Appl. No.: 220,866

[22] Filed: Dec. 29, 1980

[51] Int. Cl.[3] ..... H01Q 21/00

[52] U.S. Cl. ..... 343/836; 343/838; 343/837

[58] Field of Search ..... 343/854, 836, 837, 838, 343/839, 840, 781 R, 781 CA

[56] References Cited

U.S. PATENT DOCUMENTS

| | | | |
|---|---|---|---|
| 2,703,506 | 3/1955 | Kelly | 343/837 |
| 3,148,370 | 9/1964 | Bowman | 343/756 |
| 3,231,892 | 1/1966 | Matson et al. | 343/775 |
| 3,261,850 | 10/1966 | Hannan et al. | 343/756 |
| 3,271,771 | 9/1966 | Hannan et al. | 343/756 |
| 3,769,623 | 10/1973 | Fletcher et al. | 343/909 |
| 3,842,421 | 10/1974 | Rootsey et al. | 343/837 |
| 3,953,858 | 4/1976 | Ohm | 343/837 |
| 4,017,865 | 4/1977 | Woodward | 343/781 CA |

*Primary Examiner*—David K. Moore

*Attorney, Agent, or Firm*—Robert K. Stoddard; Edward J. Radlo; Robert D. Sanborn

[57] ABSTRACT

A single microwave-reflective antenna "dish" can be used in combination with a plurality of multiple-beam microwave feed arrays to generate or receive multiple-beam-path microwave radiation in several different frequency bands. Each of the feed arrays may operate in a discrete band of frequencies, with the combined radiations of all the arrays illuminating the reflector along a single axis. The optical system is based on the Newtonian model, such that the radiations from several arrays located off the principal axis may be combined by corresponding frequency-sensitive reflective surfaces located on the principal axis. Each of these reflective surfaces serves to direct the radiations from a single feed array toward the reflective antenna, and reciprocally, to direct radiation from the antenna to the associated feed array. By using frequency-sensitive surfaces as reflectors, a number of feed arrays can be positioned along the principal axis, the associated reflectors being reflective only at the frequency of the feed array concerned, and transparent at other frequencies.

11 Claims, 3 Drawing Figures

MULTIPLE FREQUENCY BAND, MULTIPLE BEAM MICROWAVE ANTENNA SYSTEM

BACKGROUND OF THE INVENTION

I. Field of the Invention

The apparatus of this invention is an antenna system especially useful in a mobile, airborne, or satellite communication system, or in any other application in which multiple-beam, multiple frequency band microwave transmission and reception are required in an especially compact package. However, it is principally intended for use in satellite communication stations for use both in military and civilian systems.

Such satellite communication systems have come to be used for a variety of purposes such as meteorological data gathering, ground surveillance, the telemetry of various other data, and the retransmission of commercial television entertainment programs. Since the cost of placing a satellite in orbit is considerable, each satellite must desirably serve as many communication purposes and cover as many frequency bands as possible. In order to serve many of the purposes for which satellites are useful, the communication system must be able to accurately "tailor" the transmission and reception patterns or Earth in such a way as to accurately control the regions to which transmissions are being directed, and from which signals are being received. Moreover, the accurate control of signal strength within a given transmission area makes possible the production of greater signal strength in precisely those local regions within the transmission area where reception would otherwise be difficult because of geography or jamming of the signal by other signal sources, etc. For these reasons, the use of multiple-beam transmission has come into being, permitting many widely separated areas to be placed into communication with one another, or permitting the accurate shaping of the beam profile to fit the reception or transmission area.

The corresponding necessity to generate a composite beam from a number of discrete beamlets has led to the substitution of multiple feed arrays in place of the single horns formerly used to feed the antenna system. Such arrays consist simply of a relatively large number of horns grouped closely together and individually energized. Their radiations are directed toward a common reflector which produces the focussed beam or beams propagating toward Earth. Since such multiple feed arrays may comprise as many as one hundred individual horns, their size is large enough to render their placement directly on the reflector axis impractical from the standpoint of excessive beam interception by the feed array itself. Consequently, offset designs in which the feed array is placed slightly to one side of the main propagating beam from the reflector antenna have come into use.

Such offset designs have been quite well developed, and have resulted in very successful multiple-beam antenna systems. However, each multiple feed array has generally required its own reflector antenna, a requirement which quickly becomes onerous in the case that several different frequency bands, each needing a separate feed array, have to be accommodated. Reflector antennas and the space needed to store them on a satellite prior to deployment are major items of bulk and weight in the total of all equipment used in a satellite communication station. Consequently, great advantages in terms of reduced cost and complexity would result if it were possible to use but a single reflector antenna for all of the multiple-beam feed arrays, and hence for all frequency bands for which the satellite is intended. Conversely, the number of communication channels per satellite could be expanded, such that the total cost of providing and maintaining a large range of satellite communication services could be reduced.

II. Description of the Prior Art

U.S. Pat. No. 3,148,370 issued Sept. 8, 1964 to D. F. Bowman, covering a particular pattern of a frequency-selective mesh for use as a microwave reflector. However, the patent does disclose at FIGS. 7 & 8 and the corresponding portions of the specification, an antenna system which may be used to form a single beam from two microwave feed sources. However, the feed sources utilized by Bowman are single horns, one of which must actually be mounted in the main reflector of his Cassegrainian reflector system, while the other is located at the prime focus of the reflector. Consequently, there is no way to expand the Bowman system to accommodate a plurality of microwave feeds operating at several or many different frequencies. Moreover, this prior art antenna system really is not appropriate for use with multiple-beam feed arrays in any case, since such arrays are generally so large as to make their use inefficient unless they are located off the principal axis of the optical system, as stated in section I. of this disclosure.

U.S. Pat. No. 3,394,378 issued July 23, 1968 to LaVergne E. Williams et al, and disclosed a Cassegrainian-Gregorian antenna system (FIG. 3) in which the microwave radiations of three separate feeds are combined into a single beam by the use of a single frequency-selective surface 25. Once again, the feeds involved are merely single horns, and the antenna system is an entirely rotationally symmetrical type which would not be appropriate for use with large multi-beam feed arrays because of the aforementioned problem of beam cutoff and interception caused by the presence of the feed arrays themselves.

U.S. Pat. No. 3,271,771 issued Sept. 6, 1966 to P. W. Hannan et al, and disclosed an antenna system based on the Cassegrainian model in which a first microwave source located at the Cassegrain focus, and a second source at the prime focus are combined in the output beam by means of a polarization-sensitive secondary mirror. Except for the teaching of the use of discrimination between the two sources on the basis of polarization, the Hannan et al patent adds nothing of significance to the prior art under discussion here. In particular, Hannan et al does not address the problems of how to accommodate a multiple feed array in his antenna system, or how to extend his system to encompass the use of more than two feeds.

U.S. Pat. No. 4,017,865 issued Apr. 12, 1977 to Oakley McDonald Woodward, and covers a Cassegrainian system very much like the one utilized by Hannan and others, excepting the use of a frequency-selective surface instead of a polarization-sensitive surface as the subreflector.

U.S. Pat. No. 3,281,850 to P. W. Hannan issued Oct. 25, 1966, and details a number of antenna systems in which single or dual microwave feeds are combined in Cassegrainian systems using frequency differences in the sources as a basis for subreflector discrimination. Again, there is no suggestion as to how to extend the system to three or more sources, or as to how to accommodate multiple feed arrays in this axially symmetric system.

U.S. Pat. No. 3,231,892 issued Jan. 25, 1966 to J. L. Matson et al, and covers a Cassegrainian system in which two sources at different frequencies are combined in the output beam by means of a frequency-selective subreflector.

U.S. Pat. No. 3,769,623 issued to Fletcher et al. on Oct. 30, 1973, and covers a particular design of dichroic plate in which the frequency stability with changes in incident angle is claimed to be improved. However, the patent also discloses a Cassegrainian antenna system utilizing the plate as a frequency-selective element to place an X-band and S-band source at the Cassegrainian focus of the system. However, the system is entirely unsuitable for use with relatively large multiple feed arrays, since both microwave feeds are placed within the region of space between the main and secondary reflectors of the Cassegrainian system.

SUMMARY OF THE INVENTION

The present invention mades possible the utilization of a single reflector antenna dish in combination with a plurality of multiple beam feed arrays operating in several or many frequency bands. The feed arrays are positioned of the main optical axis of the antenna system, such that the beam pattern is not distorted by unwanted intrusion of the feed arrays within the region of space along which the beam must travel. As a result, a satellite communication system can produce complex and varied beam patterns in a large number of frequency bands, and can accommodate a large number of different uses simultaneously, even though it is equipped with only a single reflector antenna.

The above and other advantages of the present invention are accomplished by the adoption of the Newtonian model for the optical system of the antenna, and by the use of a plurality of frequency-selective surfaces for the diagonal reflectors of the Newtonian system. The positioning of the several feed arrays at locations laterally displaced from the principal axis of the system avoids the beam interception which inevitably occurs when microwave feeds are placed on-axis in the Cassegrainian and Gregorian systems.

Moreover, since each off-axis source in the system of this invention is provided with its own frequency-selective diagonal subreflector, each such subreflector needs only to be reflective at the frequency of the feed array with which it is associated, and transmissive at the other frequencies of the communication system.

Finally, the provision of a unique subreflector for each of the off-axis feed arrays of the system provides an opportunity to vary, or optimize the optical system of the antenna for each feed array. This can be accomplished in accordance with the present invention by individually designing the curvature of each subreflector to fit the requirements of the frequency band and feed array with which it is used.

BRIEF DESCRIPTION OF THE DRAWINGS

The above and other detailed and specific objects, features, and advantages of the present invention will become clearer from a consideration of the following detailed description of a preferred embodiment, and a perusal of the associated drawings, in which.

DETAILED DESCRIPTION OF A PREFERRED EMBODIMENT

Figure 1:
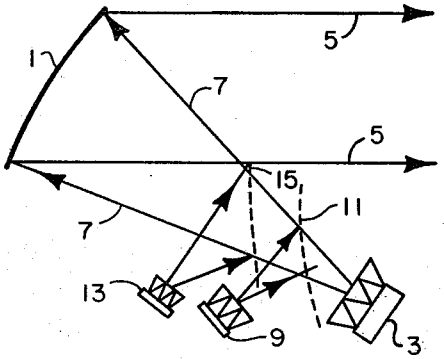
FIG. 1 is a diagrammatic side view of one embodiment of an antenna system according to the present invention.

The antenna system of FIG. 1 includes a focusing means in the form of a curvilinear reflector 1 which might be, for example, an aluminum "dish" in the shape of a paraboloid of revolution or other desired shape. At a prime focus of focusing means 1 is located a first multiple-beam microwave feed array 3. Since array 3 is located at the prime focus of focusing means 1, the region of space proximate array 3 may be thought of as a focal region within which microwave energy is brought to a focus. In a reciprocal sense, microwave energy emanating from array 3 will be focussed by focusing means 1 into a planar front propagating beam.

Rays 5 and 7 in FIG. 1 illustrate the relationship of the propagating beams, traveling along rays 5 to focusing means 1 and being focussed along rays 7 to a prime focus near the apertured horns of array 3. The antenna system of FIG. 1 is the offset type, used in order to avoid having feed array 3 placed in the path of the propagating beam traveling along the region of space delimited by rays 5.

A second microwave feed array 9, of a similar multiple beam construction but typically designed to operate in a different band of frequencies than array 3, is positioned spaced from the axis of energy propagation between focusing means 1 and array 3. Array 9 is oriented to propagate microwave energy toward and receive microwave energy from a first frequency-selective surface 11 on the axis between array 3 and focusing means 1. Surface 11 is designed to be reflective at the frequency of array 9, but transparent at other frequencies, particularly the frequency of feed array 3. Frequency-selective surface 11 is oriented so as to reflect microwave radiations from feed array 9 toward focusing means 1, and reciprocally, to reflect microwave radiations from focusing means 1 to feed array 9, if those radiations fall in the frequency range within which surface 11 is reflective. Frequency-selective surface 11 may be planar, corresponding to the diagonal flat mirror used at the corresponding point in the Newtonian optical telescope system, or curvilinear in any desired form such as spherical, hyperbolic, or other. Consequently, within the context of the present invention, surface 11 may serve not only in its primary role as a means of integrating microwave feed array 9 into the antenna system such that it appears in an optical sense to be located on the axis between array 3 and focusing means 1, but also as a means of optimizing the optics of the antenna system for feed array 9 independently of feed array 3. This is possible because surface 11 is transparent at the frequency of feed array 3 such that any alterations to its configuration are invisible to array 3, and affect only the optics of the system as presented to array 9.

By taking advantage of the freedom to optimize the optical system for each individual microwave feed, it is possible to achieve a degree of control which would not be available if all frequency bands with which the system is used were produced by a single broadband feed array, even if that were possible. As an example only, surface 11 has been illustrated as convexly curved in a direction toward feed array 9. Although the exact shape of this curvature has not been specified, it will be obvious to those skilled in the art that the prime consequence of this curvature is to lengthen the focal length of the optical system "seen" by feed array 9 as compared to the focal length presented to feed array 3. Other optimizations are possible, even including aspherical or irregular surfaces as desired.

A third microwave feed array 13 is disposed spaced from the major optical axis of the system, oriented toward that axis, and generally in a plane defined by feed arrays 3 and 9, and focusing means 1. A second frequency-selective surface 15 is positioned on the major axis of the optical system, and is so oriented as to direct microwave radiation from feed array 13 to focusing means 1, and reciprocally, as before. Feed array 13 is a multiple-beam feed array, similar to arrays 3 and 9 except designed to operate in a third frequency band. Similarly, frequency-selective surface 15 is similar to surface 11, except that it must be reflective at the frequency of feed array 13, and transparent at the frequencies of both array 3 and array 9. As in the case of frequency-selective surface 11, surface 15 may be designed to optimize the optics of the antenna system as presented to feed array 13, although surface 15 has actually been illustrated in FIG. 1 as being flat of planar.

Figure 2:
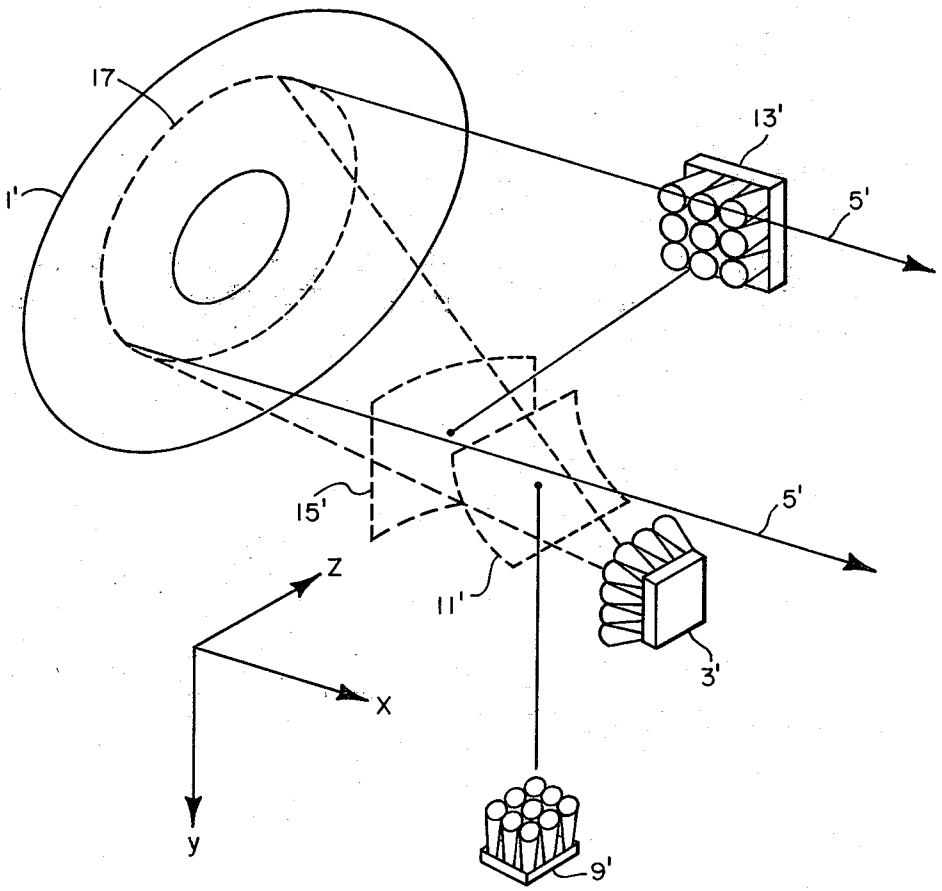
FIG. 2 is a diagrammatic perspective view of another embodiment of an antenna system according to the present invention.

Turning now to FIG. 2, a second embodiment of the present invention has been illustrated. In FIG. 2, the possibility of rotationally spacing the feed arrays about the principal axis of the system has been illustrated. Thus in FIG. 2, the second multiple-beam feed array 9' and the third feed array 13' are shown to lie along the Y-axis and Z-axis, with the principal axis being the X-axis in the coordinate system illustrated in FIG. 2. However, many other possibilities exist for utilizing the teachings of the present invention to achieve compact antenna systems in which several multiple-beam arrays are disposed spaced around the principal axis of the system, or are oriented to radiate and receive microwave energy along axes which are not orthogonal to the principal axis of the antenna optical system.

In FIG. 2, each of the three feed arrays 3', 9', and 13' has been illustrated as comprising an array of circular waveguides; however, the scope of the invention extends also to the use of rectangular or any other known types of feed arrays.

Also in FIG. 2, the area subtended by each of the multiple beams from the three feed arrays has been illustrated by dotted line 17 from which rays 5' extend. However, it will be understood that the system could be so designed that the illuminated area on focusing means 1' need not be the same for each of the feed arrays, or for any other feed arrays which might be used with the system.

Moreover, although the invention has been described in the case of both FIGS. 1 and 2 as utilizing a reflective focusing means 1 or 1', respectively, it will be understood by those skilled in the art that the teachings of this invention are equally applicable to antenna systems employing a microwave lens as a focusing means.

Figure 3:
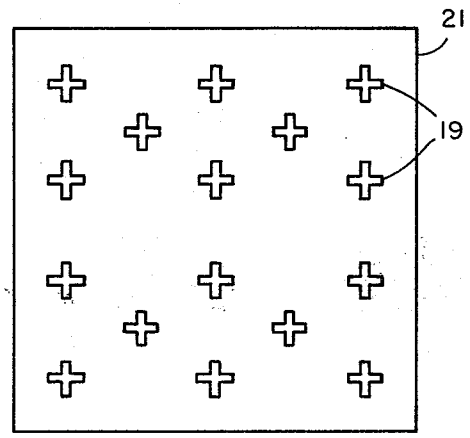
FIG. 3 is a plan view of a frequency selective surface useful in the antenna systems of the present invention.

Turning now to FIG. 3, one of many known types of frequency-selective surface which may be used in the practice of the present invention is illustrated. The frequency-selective surface of FIG. 3 is described in "Scattering from Periodic Arrays of Crossed Dipoles" by Pelton and Munk, in *IEEE Transactions on Antennas and Propagation,* Vol. AP-27, No. 3, may 1979.

The frequency-selective surface of FIG. 3 may be simply realized by forming a plurality of spaced, conductive crossed dipoles 19 on a dielectric substrate 21, as by well-known printed circuit techniques of fabrication. As discussed by Pelton and Munk in the cited IEEE paper, the array of crossed dipoles exhibits a reflection-coefficient versus frequency characteristic which is saddle-shaped, having a pair of resonances where the dipole elements are on the order of a half-wavelength long and the reflection coefficient is high, separated by an antiresonance betweeen the two peaks, at which antiresonance the reflection coefficient is low. Obviously, such a characteristic lends itself to use in the present invention in a number of ways, involving use of either or both resonant peaks and the antiresonance as well. However, those skilled in the art will find examples of other structures useful in the formation of frequency-selective surfaces for employment in the present invention.

Although the invention has been described with some particularity in reference to a set of preferred embodiments which comprise the best mode known to the inventors for carring out their invention, many modifications could be made to the disclosed embodiments without departing from the scope of the invention. Consequently, the scope of the present invention is to be derived only from the following claims.

We claim:

1. A multiple frequency band, multiple beam microwave antenna system, comprising in combination:

a reciprocal focusing means for focusing planar-front microwave energy impinging thereon to a focal region at a prime focus thereof, and for reciprocally focusing microwave energy emanating from said focal region into a propagating beam of microwave energy;

a first multiple-beam microwave feed array located within said focal region and oriented to propagate microwave energy of a first frequency toward, and receive microwave energy of said first frequency from said focusing means along a unitary, straight first axis between said feed array and said focusing means, said first feed array comprising a plurality of discrete, individually energizable microwave horns arrayed generally transverse to said first axis and oriented to propagate energy therealong;

a second multiple beam microwave feed array located between said focusing means and said first feed array, spaced from said first axis and oriented to propagate microwave energy of a second frequency toward, and receive microwave energy from, a first point on said first axis, said second feed array comprising a plurality of discrete, individually energizable microwave horns;

a first frequency selective surface located at said first point on said first axis, said frequency selective surface being transparent at said first frequency and reflective at said second frequency, and being oriented to direct microwave radiation from said second feed array along said first axis toward said focusing means;

a third multiple beam microwave feed array located between said focusing means and said first feed array, spaced from said first axis and oriented to propagate microwave energy of a third frequency toward, and receive microwave energy from a second point on said first axis intermediate said first point and said focusing means, said third feed array comprising a plurality of discrete, individually energizable microwave horns;

a second frequency selective surface located at said second point on said first axis, said second frequency selective surface being transparent at said first and second frequencies and reflective at said third frequency, and being oriented to direct microwave radiation from said third feed array along said first axis toward said focusing means.

2. The antenna system of claim 1 wherein said focusing means is a curvilinear microwave reflector.

3. The antenna system of claim 1 wherein said focusing means is a concave paraboloid of revolution.

4. The antenna system of claim 1 wherein one of said frequency-selective surfaces includes an array comprising a spaced plurality of dipole elements.

5. The antenna system of claim 4 wherein said dipole elements are crossed dipoles.

6. The antenna system of claim 1 wherein one of said frequency-selective surfaces is planar.

7. The antenna system of claim 1 wherein one of said frequency-selective surfaces is curvilinear.

8. The antenna system of claim 1 wherein one of said frequency-selective surfaces is convexly curved in a direction toward said microwave feed array.

9. The antenna system of claim 1 wherein said first and second feed arrays are rotationally spaced around said first axis.

10. The antenna system of claim 9 wherein said first and second feed arrays lie in orthogonal planes through said first axis.

11. The antenna system of claim 1 wherein said first and second feed arrays and said first axis lie in a common plane.

* * * * *